United States Patent [19]

Hanson

[11] Patent Number: 4,671,141

[45] Date of Patent: Jun. 9, 1987

[54] ROTARY TORQUE DEVICE

[75] Inventor: Alan R. Hanson, Bloomington, Minn.

[73] Assignee: New Ideas Incorporated, Bloomington, Minn.

[21] Appl. No.: 777,286

[22] Filed: Sep. 18, 1985

[51] Int. Cl.[4] ..... B25B 13/50

[52] U.S. Cl. ..... 81/53.2; 81/441

[58] Field of Search ..... 81/53.2, 120, 124.3, 81/124.6, 181, 124.7, 441, 121.1; 30/277; 83/656, 652, 653, 654, 655

[56] References Cited

U.S. PATENT DOCUMENTS

| | | | |
|---|---|---|---|
| 1,093,252 | 4/1914 | Carnes | 81/181 |
| 2,538,343 | 1/1951 | Van Winkle, Jr. | 81/124.6 X |
| 3,161,090 | 12/1964 | McLellan | 81/53.2 |
| 3,354,757 | 11/1967 | Grimm et al. | 81/124.3 X |
| 4,607,547 | 8/1986 | Mantos | 81/188 |

*Primary Examiner*—Frederick R. Schmidt
*Assistant Examiner*—Maurina Rachuba

[57] ABSTRACT

An adapter tool device for transmitting rotary energy by means of special internal driving end splines to create and cut gripping channels in threaded and unthreaded cylindrical objects adapted to fit drive end shapes of rotary power sources and transfer torque from reversible and non-reversible variable speed rotary torque power sources such as impact wrenches, impact drivers and hand wrenches for in-line coincident centerlines as well as for non-coincident angularly disposed centerlines whereby rotary power is transferred to tighten or loosen cylindrical fastening components such as bolts, screws, combination nut-bolts, threaded components, non-threaded cylindrical components and the like.

4 Claims, 10 Drawing Figures

ROTARY TORQUE DEVICE

TECHNICAL FIELD

This invention relates to tools for use with rotational energy transmitting tools and more specifically for use with socket tool breaker bars or ratchet wrench devices or electric or pneumatic impact wrenches and the like which are typically used to impart tightening or loosening rotational forces on nuts, bolts or other threaded fastening devices on trucks or other large vehicles which utilize dual-wheels.

BACKGROUND OF INVENTION

It has been conventional to use with torque or ratchet wrenches or rotational impact wrenches one or more socket-like tools which extend the drive protuberance of the torque, or ratchet wrench or impact wrench. The existing socket-like tools generally have a square protuberance or a hexagonal protuberance thereon for drive transmittal of torque force from the power source. The socket-like tool has a round socket-like receptacle therein which is defined by the intersecting arcs of a series of half-round holes which are best described as relatively evenly spaced circumferentially on a circular centerline. The intersecting arcs form a connected circular series of sharp pointed scallops. The width of each said common intersecting arc line is small and each line has a ratio of arc radial height to width greater than one to one and said ratio of height to width is asymptotic to infinity. The intersecting arcs of said round holes point inwardly leaving a series of sharp lines which are of such effective diametral size and fit in combination so as to be capable of being forced in an axial centerline direction onto the threads of a bolt. The normal turning square stud on the truck wheel nut-bolt is occasionally accidentally broken off by inadvertent excessive rotational torque being applied to the square protuberance stud extension of the wheel nut-bolt which is externally and internally threaded. The externally and internally threaded wheel nut-bolt is on the bolt on which the inner dual wheel is mounted—perhaps for an extended time period of years—and the nut has occasionally corroded onto a very tight rusted fit to the threads of the bolt on which the inner dual wheel is mounted. When the square stud extension of the nut is broken off or when it is stripped to a round-like non-grippable condition, then the tool with the intersecting arcs described above or some other tool capable of gripping the external threads of the nut-bolt must be used to rotate the broken wheel nut-bolt off. Such a tool must be placed over the external threads of the nut to be removed. A square protuberance or such like torque-grippable protuberance is usually an integral portion of the other end of the tool. In the case of the intersecting lines of the multi-arc tool, such lines of said tool are driven on axially over the thread in a direction parallel to the centerline of revolution of the threaded wheel nut-bolt. This causes the threaded portions of the nut to be forced out of the way off to the side of the intersecting arc lines in a spreading type action as said arc lines are driven on as the tool is pounded on to the threaded wheel nut-bolt. Often the intersecting arc lines break off of the tool when impact torque is applied to them. This is because the arc lines are inherently weak in their tangent-like common intersections which are essentially asymptotic to a fine line which would be essentially asymptotic to zero. Such tools are of hardened steel. Such arc line tools are considered perishable in that they are usually destroyed beyond all usefulness after a relatively small number of uses—perhaps only four to ten uses. The number of uses can seriously be jeopardized by operator inattention causing use in a tightening direction rotation rather than a loosening direction rotation on the threads. This condition is also jeopardized in that the threads of the internally-externally threaded nut-bolts are either left-hand or right-hand threaded. The direction of the thread is usually stamped onto the top of the aforementioned square stud extension of the wheel nut-bolt. In such cases, this top piece is usually lost when it gets broken off; therefore, the direction of the internal threads cannot easily be seen or ascertained. This further contributes to premature perishable tool failure.

Another version of such a wheel nut-bolt device consists of a hexagonal piece of steel with a hole drilled axially through the same on the major length axis. Said hole is made to slip easily over the outside diameter of the internally-externally threaded wheel nut-bolt. Reference is made to a wheel nut-bolt as such because said wheel nut-bolt is threaded on the inside of such wheel nut-bolt (like a normal nut) and the outside is externally threaded also (like a normal bolt). While the internally threaded portion becomes the nut for the inside bolt for the inside dual wheel, the externally threaded portion becomes the bolt which receives the regular nut to hold the outside dual wheel on to the vehicle. On the aforementioned hexagonal piece of steel with the axial hole, another hole is drilled transversely through the hexagonal bar relatively close to the end of said bar—approximately three-quarters of an inch. Once the center hole of said hexagonal bar is placed over the broken wheel nut-bolt, a tapered wedge made from a round bar of close diametral fit to the aforementioned transversely drilled hole can be pounded transversely over the broken wheel nut-bolt. The tapered wedge has a flat surface on it which forces a flat torque transmitting surface on the outside threaded periphery of the broken wheel nut-bolt. In such a manner, torque applied to the external hexagonal stock is transmitted to the wheel nut-bolt through the tapered wedge and the wheel nut-bolt can be removed.

Another version of a wheel nut-bolt removal device consists of a round bar of steel with a square nut protuberance on the top such as that on the aforementioned multi-arc device. In the opposite end of the device is a hole bored to slip over the outside diameter of the wheel nut-bolt. External to this hole is a dual cammed, or inclined plane chamber with a knurled pin retained in the chamber. When the wheel nut-bolt removal device is rotated about the broken wheel nut-bolt, the cammed inclined plane causes the knurled pin to roll down into tighter contact with the external threads of the wheel nut-bolt. Increasing the turning force on the wheel nut-bolt removal device causes the knurled pin to be cammed in tighter and hence have increased rotational gripping power. In such manner, the broken wheel nut-bolt is turned off assuming the correct rotational direction is applied.

All of the above existing rotary torque tools tend to add undesirable radial compressive forces to the internal bolt from which the broken wheel nut-bolt is being attempted to be removed.

SUMMARY OF THE INVENTION

The rotary torque tool of the present invention is used to loosen wheel nut-bolts or regular bolts. Said tool is positioned between a rotational energy power source adapter and a wheel nut-bolt or regular bolt. The invention consists of a multiplicity or series of wide torque splines each equal to or greater with respect to the width of said torque splines compared to the radial height or depth of each torque splines arranged parallel to the major cylindrical axis of said invention. The height to width relationship of the torque splines is purposely less than one to one (1:1) to afford a stronger non-strip condition such as that not possessed by the multi-arc tools which have a height to width relationship approaching infinity. The internal diameter of the torque splines is bored out to a couple of thousandths of an inch bigger than the minor diameter of the wheel nut-bolt outside thread. A top rake cutting angle surface is positioned on the leading end of the torque splines so that when the rotary torque tool is pounded axially onto the wheel nut-bolt, the top rake cutting angle surface on the torque splines cuts and removes at the minor thread diameter the vee-cross-sectioned thread portions exposed to the paths of said torque splines as said invention is pounded axially onto said threaded wheel nut-bolt. The uncut axial portions of threads between the portions removed by the torque splines provides a strong resisting grip for rotational torque transfer through the application of torque from the rotational energy transmitting tool adapter to the polygonal or square hole or square protuberance on the end of the rotary torque tool to the said torque splines to said uncut axial portions of threads. Because the top rake angle cutting surfaces on the ends of the torque splines physically remove the portions of threads ahead thereof, there are relatively little radial compressive forces transferred through the wheel nut-bolt to the internal bolt from which the broken wheel nut-bolt is being attempted to be removed. The relationship of the internal diameter of the torque splines and the minor thread diameter is such that if the top rake angle cutting surface does not cut into the threads or bolt on one side, the cutting surfaces cuts in deeper on the opposite diametral side giving a compensating cutting action which tends to keep the rotary torque transfer capability relatively constant with regard to stripping out. The width arrangement of the torque splines and the number thereof coupled with the threaded spaces in between said torque splines serves to allow some adjustment within reason of the resistance to torque strip-off of said threaded spaces and consequent undesirable tool inaction failure due to thread stripping. The tools are of hardened steel harder than the wheel nut-bolt threads being cut or removed. The rotary torque tool will apply the same thread removal action to a solid bolt as it will to the external threads of an internally threaded wheel nut-bolt when the rotary tool is diametrically sized to said threaded solid bolt.

BRIEF DESCRIPTION OF THE DRAWINGS

Referring to the accompanying drawings, several embodiments of the present invention are illustrated, wherein.

OBJECTS

Figure 1:
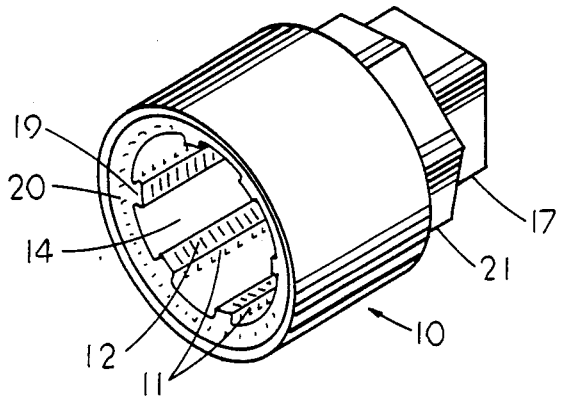
FIG. 1 is an isometric perspective view of one embodiment of the rotary torque tool showing one form of the top rake angle cutting surfaces end and the torque imparting gripper shapes torque splines which defines the longitudinal axis of the torque tool.

Accordingly, it is an object of this invention to provide a novel single piece rotational energy torque transmitting tool possessing new, important and significant valuable, useful results.

Another object is to provide a rotary tool capable of removing broken or stripped threaded wheel nut-bolts and broken bolts.

A further object is to provide a rotary tool capable of being gripped on or in by a torque generating tool or machine power source without rotational slippage on the threaded piece being removed.

Another object of the invention is to provide a tool which is economical to manufacture and easily produced using manufacturing processes other than and in addition to normal metal removing processes.

A further object is to produce a rotary torque tool which possesses the ability to stand up to severe adverse rotational torque forces without premature torque transferring element failure of the internal torque transferring member splines.

A further object is to produce a tool that has a low radial height to width ratio of torque transferring spline elements, said ratio diverging from that of being asymptotic to infinity and approaching one to one or less.

Another object is to provide a tool device capable of faster rotational operation than conventional wrenches while also being conveniently usable with electric, pneumatic, or hydraulic energy converted to rotational force such as with electric, pneumatic or hydraulic impact wrenches or hand-held impact drivers.

Another object is to provide a tool capable of transmitting rotational torque forces through both coincident centerline alignment conditions of the torque generating device, the tool adapter, the rotary torque tool and the wheel nut-bolt and through non-coincident centerline conditions of the wheel nut-bolt and the rotary torque tool while the rotary torque tool, adapter and torque generating device have coincident centerline alignment conditions.

A further object is to provide a hardened steel tool which can be repeatedly pounded onto the outer threads of a wheel nut-bolt physically removing portions of said outer threads.

Another object of the invention is to provide a tool which can be used with strong torque producing hand tools of the type normally possessed by most heavy duty vehicle owners and most non-professional repairmen but not normally used in a production repair mode by professional repair mechanics.

Another object is to produce a tool which can be used by a vehicle driver on the road away from a vehicle wheel repair station.

Another object is to provide a tool capable of removing specific desired sections of threads from bolts or screws.

A further object is to provide a tool capable of broaching solid steel sections from the solid diametral portion of a bolt or screw with the head broken off therefrom.

Another object is to provide a tool capable of becoming the external equivalent of a broken screw or bolt removal device such as a bolt extractor tool.

A further object is to provide a tool which is capable of transmitting torque consecutively or alternatively in clockwise and counterclockwise rotational directions without premature failure of the internal torque imparting gripper shapes.

Another object is to provide a tool which will not add undesirable internally directed radial compressive forces to the object upon which the tool is working when the diameter of the circumferential arcs is increased axially inwardly to alleviate intimate diametral contact of the innermost axial surfaces of the circumferential arcs upon the paths of the removed material.

A further object is to provide a tool which is easily removable from the fastening device that it has been pounded onto after the tool has performed its rotary torque removal function.

Another object is to provide a tool with cutting surfaces on torque splines at both ends of said tool in order to double the cutting life of said rotary torque tool.

A further object of the invention is to provide said double-ended cutting spline tool with one end of long guided aligning splines centering action for longer bolts and the opposite end with short guided aligning splines centering action for shorter bolts broken off closer to the surface in which the bolt is fastened or embedded therein.

Another object is to provide a device which can perform as a torque power transferring connector.

A further object of the invention is to provide a device which gains some of its significant mechanical design and production features via the investment casting process, the gaining of which said significant mechanical design and production features would be economically nonfeasible and virtually impossible in a practical and cost-wise sense with conventional machining and metal removing methods and techniques.

Further objects and advantages of the invention will become apparent from considering the accompanying drawings and ensuing description thereof.

BEST MODE FOR CARRYING OUT THE INVENTION

With reference to FIG. 1, an isometric perspective view of a torque tool 10, said torque tool 10 has a multiplicity of torque splines 11 internal to said torque tool 10. The torque splines 11 are driven axially down the threads of the wheel nut-bolt. The top rake angle cutting surfaces 19 on the open end of the torque splines 11 removes portions of the external threads of the wheel nut-bolt. The torque splines 11 may be of any number consistent with the design size of the torque tool 10 which is dependent within reason on the size of truck nut-bolt or bolt upon which said torque tool 10 is to be used. An essential part of the torque splines 11 is that the ratio of the effective side radial height 13 of the torque splines 11 of FIG. 2 to the width of the circumferential arc 12 of FIG. 2 be relatively small; preferably at least one to one and diverging from that of being asymptotic to infinity like that of the intersecting arcs of the aforementioned existing socket-like tool extensions having a series of intersecting arcs of half-round holes. Thread relief diameter 14 of FIG. 1 and FIG. 2 determines a part in this ratio. This ratio produces a torque tool 10 capable of withstanding adverse wrong direction rotation and prevents consequent premature torque splines 11 rotational break-off or strip-out failure from the torque tool 10.

Figure 2:
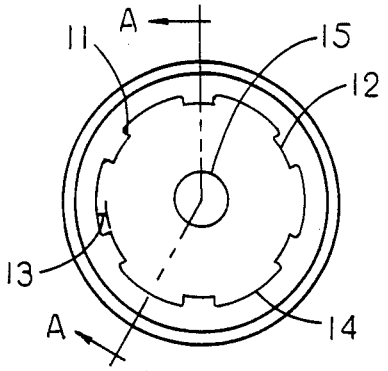
FIG. 2 is a left end view of the torque imparting gripper shapes torque splines of the rotary torque tool shown in FIG. 1

FIG. 2 is a left end view of the open end of torque tool 10 of FIG. 1. The circumferential arc 12 of FIG. 2 is determined when the effective cutting diameter of the torque splines 11 is rotationally machined. This cutting diameter is dictated by the minor diameter of the thread on the bolt to be removed. The difference between the torque spline diameter at the circumferential arc 12 and the thread relief diameter 14 between the cutting splines 11 divided by two determines the side radial height 13.

Figure 3:
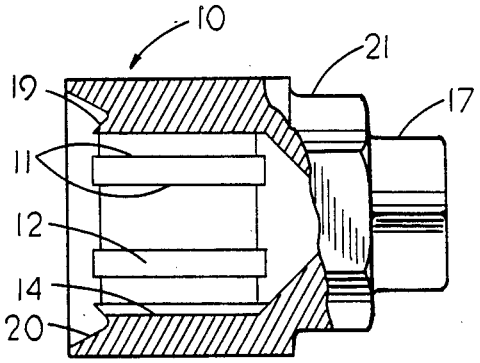
FIG. 3 a side view with a partial cross-sectional view along section lines A—A in FIG. 2 of the rotary torque shown in FIG. 1.

The ejection hole 15 of FIG. 2 is used to drive a pin or smaller bolt through to remove the broken wheel nut-bolt from the torque tool 10 after the torque tool 10 has been pounded on and has removed the broken wheel nut-bolt from the wheel bolt. The ejection hole 15 of FIG. 4 has a chamfer 16 about the same to absorb any peened malleable metal about said ejection hole 15 keeping said ejection hole 15 at full open diametral size when the square protuberance 17 of FIG. 3 is struck by a hammer or like object as the torque tool 10 is pounded axially onto a broken wheel nut-bolt or broken bolt. The chamfer 16 about the square drive hole 18 of FIG. 6 has the same peened metal absorption objective—namely to keep the square hole 18 at full square open size.

FIG. 3 is a section view of FIG. 2 taken along section line A—A of FIG. 2. The top rake angle cutting surfaces 19 of FIG. 3 removes the threads of the wheel nut-bolt which are in front of the torque splines 11 as the torque tool 10 is pounded axially onto a broken wheel nut-bolt or broken bolt.

The torque splines 11 of FIG. 1 moves axially down the wheel nut-bolt when the torque tool 10 is pounded onto a wheel nut-bolt. The top rake angle cutting surfaces 19 cuts each thread ahead of it off close to the minor diameter of the external thread of the wheel nut-bolt. The cross-section of the thread pieces removed is essentially that of an equilateral triangle when removed from a normal 60° thread in the normal broaching cutting action of the torque tool 10. The sharpness of the acute top rake angle cutting surfaces 19 determines the thread removal cutting force component of the axial force vector component of the torque tool 10 generated when said torque tool 10 is pounded onto the broken wheel nut-bolt. A practical limit of sharpness is determined by a design trade-off of shock-impact breakage resistance of the top rake angle cutting surfaces 19 versus toughness, strength and hardness of the torque splines 11.

The thread chips are removed progressively due to the helix angle of the thread on the wheel nut-bolt being different than the non-helix angle of the top rake angle cutting surfaces 19 of the multiplicity of torque splines 11.

The removed threaded pieces are allowed to escape the physical association of the torque splines 11 and the wheel nut-bolt via the multiplicity of chip removal channels 20 preceding the torque splines 11 of FIG. 3. The center of the radius joining the cutting surfaces of the torque splines 11 and the surface of the chip removal channels 20 of FIG. 3 is outside of the thread relief diameter 14 of FIG. 3. This center of the radius positioning assures the cutting removal of the thread chips before said removed thread chips are redirected outward via the chip removal channels 20 from the cutting torque tool 10 of FIG. 1 and FIG. 3.

Figure 4:
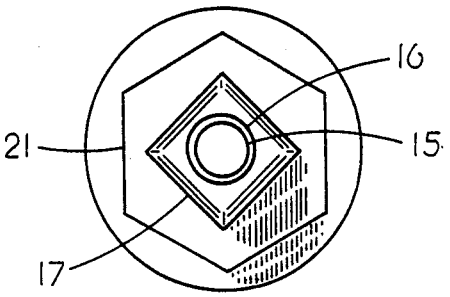
FIG. 4 a right end view of the square and hexagonal protuberance of the rotary torque tool shown in FIG. 1.

FIG. 4 is a right end view of FIG. 1 showing the ejection hole 15 with chamfer 16 and the hexagonal drive protuberance 21 and the square drive protuberance 17. Said drive protuberances are engaged by the torque driver members of the impact wrench as the impact wrench transfers rotary force to the torque tool 10 and consequently the torque spine(s) 11.

Figure 5:
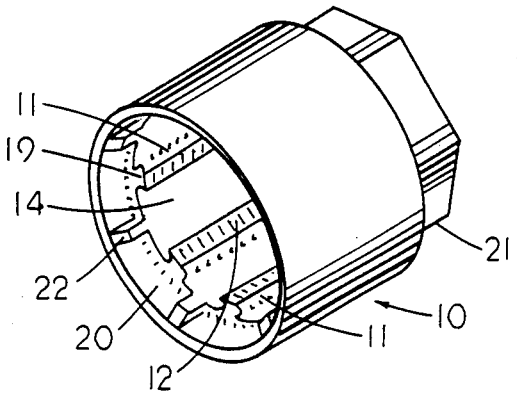
FIG. 5 is an isometric perspective view of another embodiment of the rotary torque tool showing another embodiment of the internal torque splined cutting end of said tool with accentuated lead-on guide aligning splines interspersed between the internal cutting torque splines and with the torque drive end modified as in FIG. 6.
Figure 6:
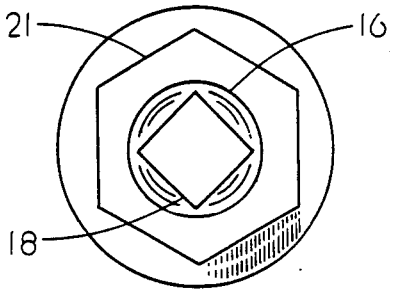
FIG. 6 is a right end view of FIG. 5 showing another embodiment of the rotary torque tool having a plurality of torque imparting drive shapes with one of the torque drive shapes internal to the external hexagonal second torque drive shape as compared to the external extended square torque drive shape protruding from the external hexagonal second torque drive shape as shown in FIG. 3 and FIG. 4.

FIG. 5 is another isometric perspective view of another embodiment of the torque tool 10 with a combination hexagonal drive protuberance 21 with an internal square drive hole 18 therein, as shown in FIG. 6. The embodiment of FIG. 5 shows a combination of the multiplicity of torque splines 11 with non-cutting aligning splines 22. The non-cutting aligning splines 22 is interspersed between the torque splines 11 which is set deeper axially internally as shown in FIG. 8 in the torque tool 10 in order to allow the aligning splines 22 a chance to roughly center the torque tool 10 on a wheel nut-bolt before the top rake angle cutting surfaces 19 starts cutting into the threads of the wheel nut-bolt or bolt.

FIG. 6 is a right end view of the isometric view, FIG. 5. FIG. 6 shows another embodiment of the invention incorporating a square drive hole 18 with a chamfer 16 within the hexagonal drive protuberance 21. The square drive hole 18 allows a protuberance of a tool such as a socket wrench or a small impact driver or wrench to be inserted into the square drive hole 18 for torque transmittal purposes.

Figure 7:
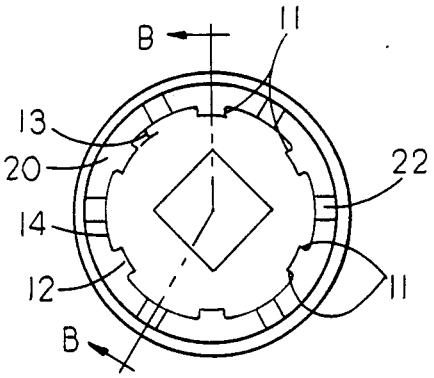
FIG. 7 is a left end view of the internal splined cutting ends with the accentuated lead-on guide aligning splines of FIG. 5 interspersed between the internal combined cooperative top rake angle cutting surfaces and the torque splines.

FIG. 7 is a left end view of the embodiment shown in FIG. 5. The non-cutting aligning splines 22 is shown interspersed between the torque splines 11 in FIG. 7.

Figure 8:
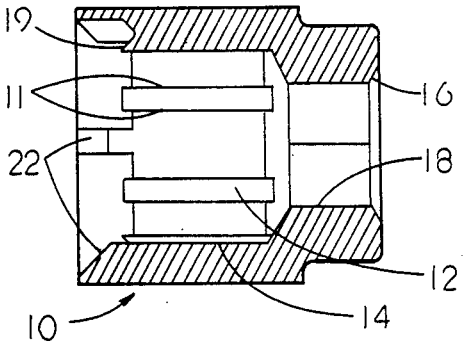
FIG. 8 is a cross-sectional view of the rotary torque tool section lines B—B of FIG. 7.

FIG. 8 is a section view of the embodiment of FIG. 5 taken along section lines B—B of FIG. 7. The square drive hole 18 is internal to the hexagonal drive protuberance 21 as shown in FIG. 6. Either the hexagonal drive protuberance 21 or the square drive hole 18 are used to transfer torque from the torque driver to the torque splines 11.

Figure 9:
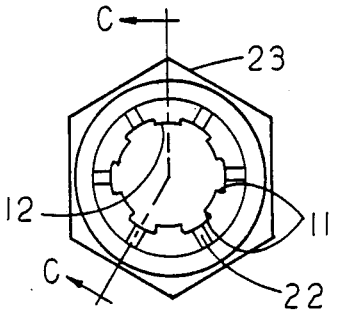
FIG. 9 is an end view of another embodiment of the rotary torque tool invention showing the internal torque splines encased in a hexagonal external shape. The opposite end of FIG. 9 is essentially the same configuration as that shown.
Figure 10:
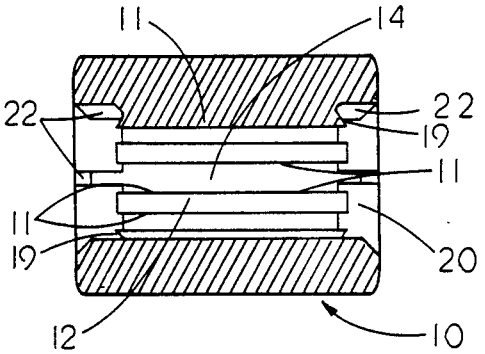
FIG. 10 is a cross-section of FIG. 9 along section lines C—C of FIG. 9 providing the capability of a double-ended internal cutting torque splines arrangement.

FIG. 9 is an end view of another embodiment of the invention showing an external hexagonal drive configuration 23 with the aligning splines 22 while the torque splines 11 extends through the length of the torque tool 10 as shown in FIG. 10.

FIG. 10 is a cross-section view of FIG. 9 taken along section lines C—C of FIG. 9. This embodiment and torque splines 11 combinations yield a double ended torque tool theoretically giving double tool life.

Said aligning splines 22 such as in FIG. 8, FIG. 9 and FIG. 10 can be used on the torque tool 10 which can also be produced without aligning splines 22 while letting the thread relief diameter 14 of FIG. 2, FIG. 3, FIG. 7 and FIG. 8 perform the aligning function in a coarse action after the torque splines 11 has started cutting threads on the wheel nut-bolt.

Another embodiment of the hexagonal drive configuration 23 of FIG. 9 would close one end of the hexagonal drive configuration 23 with either a square drive protuberance 17 like in FIG. 3 or a square drive hole 18 like in FIG. 7 and FIG. 8.

It is understood that suitable modifications and configurations are only limited to those within the spirit and scope of the appended claims. Having now, therefore, fully illustrated and described the invention, what I claim to be new and desire to protect by Letters Patent is set forth in the appended claims.

What is claimed is:

1. A rotary tool for the removal of threaded fasteners, comprising a cylindrical housing having a central longitudinal axis, an outer diameter, an inner diameter defining an interior cylindrical wall, a first end having a drive means for transmitting torque form a rotary power source, and a second end providing an opening into a space defined by said interior cylindrical wall; a multitude of splines, axially aligned on the interior wall, said splines having ends adjacent said second housing end; top rake angle cutting surface means on said spline ends; and a chip removal channel means, formed in said interior wall and located between said top rake angle cutting surface means and said second housing end; whereby when said tool is forced axially on to said fastener, the top rake angle cutting surface means cuts away material to form mating surfaces on the fastener, said mating surfaces cooperating with the splines so that the splines may transmit torque to the fastener when the tool is rotated.

2. The tool of claim 1, further comprising guide means to align said tool onto the threaded fastener, said guide means placed alternatively with the splines, and located on said interior cylindrical wall between the top rake angle cutting surface means and the second housing end.

3. The tool of claim 2, further comprising relief diameter means axially aligned on the interior cylindrical wall between said splines, to provide clearance for the uncut portions of the threaded fastener.

4. The tool of claim 3, whereby each of said splines is shaped to provide for maximum torque transferring areas, wherein the spline has a top longitudinal surface in the shape of an arc, perpendicular in cross section to the longitudinal sides of said spline, and said spline is at least half as wide as it is radially high, as measured from the interior housing wall.

* * * * *